US010121342B2

(12) United States Patent
Alvarez et al.

(10) Patent No.: US 10,121,342 B2
(45) Date of Patent: Nov. 6, 2018

(54) SECURITY TAG WITH STAIN PREVENTION PADS

(71) Applicants: Richard D. Alvarez, Boca Raton, FL (US); Gilbert Fernandez, Weston, FL (US); Photra Som, Boca Raton, FL (US); Kelvin Lee Hunter, Lake Worth, FL (US)

(72) Inventors: Richard D. Alvarez, Boca Raton, FL (US); Gilbert Fernandez, Weston, FL (US); Photra Som, Boca Raton, FL (US); Kelvin Lee Hunter, Lake Worth, FL (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 0 days.

(21) Appl. No.: 15/727,800

(22) Filed: Oct. 9, 2017

(65) Prior Publication Data

US 2018/0158301 A1 Jun. 7, 2018

Related U.S. Application Data

(60) Provisional application No. 62/431,335, filed on Dec. 7, 2016.

(51) Int. Cl.

| | |
|---|---|
| ***E05B 65/00*** | (2006.01) |
| ***E05B 73/00*** | (2006.01) |
| ***G08B 13/24*** | (2006.01) |

(52) U.S. Cl.
CPC ..... *G08B 13/2434* (2013.01); *E05B 73/0017* (2013.01); *E05B 73/0035* (2013.01); *E05B 73/0052* (2013.01); *E05B 73/0064* (2013.01)

(58) Field of Classification Search
CPC ..... E05B 73/0017; E05B 73/035; E05B 73/0064; E05B 73/0052; E05B 73/00; E06B 3/6715; E06B 3/66319; E06B 3/66328; G08B 13/2434
See application file for complete search history.

(56) References Cited

U.S. PATENT DOCUMENTS 4,670,950 A * 6/1987 Wisecup ..... E05B 73/0017 116/200
4,774,503 A * 9/1988 Bussard ..... E05B 73/0017 340/572.9
4,803,053 A * 2/1989 Williamson ..... B01L 3/565 222/570
4,949,559 A * 8/1990 Glines ..... B60R 7/14 211/64
5,002,624 A * 3/1991 Howell ..... B29C 47/0019 156/243

(Continued)

*Primary Examiner* — Hoi Lau
(74) *Attorney, Agent, or Firm* — Fox Rothschild LLP; Robert J. Sacco; Carol E. Thorstad-Forsyth

(57) ABSTRACT

Systems and methods for operating a security tag. The methods comprise: disposing a portion of an article between at least a first pad and a second pad of the security tag; applying a compressive force to the portion of the article disposed between the first and second pads; and concurrently providing by the first and second pads (A) a non-slip grip on the portion of the article and (b) prevention of article staining caused by at least one of oxidization, a chemical interaction, and outgassing.

20 Claims, 14 Drawing Sheets

(56) References Cited

U.S. PATENT DOCUMENTS 5,007,217 A * 4/1991 Glover ..... E06B 3/66328 428/34
5,019,801 A * 5/1991 Anderson, III ..... E05B 73/0017 340/522
5,068,641 A * 11/1991 Hogen Esch ..... E05B 73/0017 340/551
5,437,172 A * 8/1995 Lamy ..... B65D 73/0064 206/807
5,662,737 A * 9/1997 Chen ..... C04B 35/50 106/287.18
5,841,349 A * 11/1998 Holmgren ..... E05B 73/0017 340/572.2
5,928,154 A * 7/1999 Silber ..... B25G 1/10 600/459
5,983,593 A * 11/1999 Carbary ..... E06B 3/6715 156/109
6,285,286 B1 * 9/2001 Tyren ..... E05B 73/0017 340/426.28
6,374,647 B1 * 4/2002 Holmgren ..... E05B 73/0017 70/57.1
6,612,139 B1 * 9/2003 Costa ..... E05B 73/0017 24/704.1
7,808,386 B1 * 10/2010 Sayegh ..... E05B 73/0017 235/385
8,294,583 B2 * 10/2012 Sayegh ..... E05B 73/0017 24/16 PB
8,334,501 B1 * 12/2012 Cox ..... G02B 6/3514 250/221
8,390,460 B2 * 3/2013 Zinner ..... B65D 55/02 340/572.9
8,416,082 B2 * 4/2013 Sayegh ..... G08B 13/2434 24/16 PB
8,890,694 B2 * 11/2014 Yang ..... H05K 5/0208 340/10.1
9,404,289 B2 * 8/2016 Sayegh ..... E05B 73/0017
9,907,374 B2 * 3/2018 Canaday ..... A45C 11/182
2001/0001357 A1 * 5/2001 Reichert ..... E06B 3/66319 52/786.13
2002/0010265 A1 * 1/2002 Johnson ..... C08L 23/00 525/74
2002/0168401 A1 * 11/2002 Kanios ..... A61F 15/001 424/449
2003/0075214 A1 * 4/2003 Fraas ..... F23C 3/002 136/253
2006/0070410 A1 * 4/2006 Fuss ..... E05B 73/0017 70/57.1
2007/0295039 A1 * 12/2007 Belden, Jr. ..... E05B 73/0041 70/57.1
2008/0030334 A1 * 2/2008 Marsilio ..... E05B 73/0017 340/572.1
2008/0061987 A1 * 3/2008 Kolton ..... E05B 73/0035 340/572.9
2008/0198022 A1 * 8/2008 Battles ..... B41M 5/52 340/572.8
2008/0217947 A1 * 9/2008 Merryman ..... B60R 13/0815 296/39.1
2008/0272917 A1 * 11/2008 Feibelman ..... E05B 73/0017 340/572.9
2008/0284601 A1 * 11/2008 Sayegh ..... E05B 73/0017 340/572.1
2008/0289372 A1 * 11/2008 Rendon ..... E05B 73/0017 70/57.1
2010/0060460 A1 * 3/2010 Zinner ..... B65D 55/02 340/572.9
2010/0126238 A1 * 5/2010 Mazzucchelli ..... E05B 73/0035 70/58
2010/0176951 A1 * 7/2010 Zinner ..... E05B 73/0035 340/572.9
2010/0277323 A1 * 11/2010 Feibelman ..... E05B 73/0035 340/572.8
2011/0018716 A1 * 1/2011 Piccoli ..... E05B 73/0017 340/572.9
2012/0000254 A1 * 1/2012 Zhao ..... E05B 73/0017 70/58
2012/0174635 A1 * 7/2012 Pierobon ..... E05B 73/0017 70/276
2012/0234056 A1 * 9/2012 Thoonsen ..... E05B 67/10 70/52
2015/0123799 A1 * 5/2015 Strassburger ..... G08B 13/2434 340/572.9
2015/0187459 A1 * 7/2015 Fairchild ..... C08L 23/16 523/219
2016/0102483 A1 * 4/2016 Luo ..... E05B 73/0017 70/57.1
2016/0258192 A1 * 9/2016 Bouan ..... E05B 73/0017
2017/0140256 A1 * 5/2017 Kobata ..... G06K 19/07722
2018/0152217 A1 * 5/2018 Laird ..... H04B 1/3888
2018/0158301 A1 * 6/2018 Alvarez ..... G08B 13/2434

* cited by examiner

SECURITY TAG WITH STAIN PREVENTION PADS

CROSS-REFERENCE TO RELATED APPLICATIONS

This application claims priority to U.S. Patent Application No. 62/431,335 which was filed Dec. 7, 2016. The content of the above application is incorporated by reference in its entirety.

FIELD

This document relates generally to detectable sensors, such as Radio Frequency Identification ("RFID") sensors and/or security tags used in Electronic Article Surveillance ("EAS") systems to protect optical wear (e.g., eyeglasses and eyeglass frames). More particularly, this document relates to detectable sensors which do not stain items to which they are coupled.

BACKGROUND

In retail stores for optical articles, it is desirable to present a large variety of eyeglasses and eyeglass frames to prospective buyers in a manner which allows them easily to examine and compare a large number of different frames or eyeglasses. Eyeglasses and eyeglass frames are constructed with temple pieces or earpieces to engage a wearer's ears to hold the eyeglasses in place. The eyeglass temples are usually pivotally coupled to a lens support. The lens support may include spaced pads or an arch portion which fits the bridge of the nose. This construction is common to eyeglass frames, finished eyeglasses, sunglasses, reading glasses, goggles, protective eyewear and the like.

Eyeglasses and eyeglass frames may be expensive. Their value and relatively small size make these articles target for thieves. In order to prevent theft, optical retailers often display eyeglasses or frames in locked glass cases. This approach not only greatly increases the overhead, but also requires the presence of salespeople to allow a customer to try on a pair of eyeglasses. In addition, display cases present a barrier between the customer and the product.

Other attempts to overcome security problems include connecting eyeglass frames to a weight or fixture using cables or chains. Such devices allow customers to handle the eyeglasses and try them on without the assistance of personnel. The cable or chain connecting the model eyewear to the weight or fixture may be effective for preventing a thief from pocketing the eyewear, but there are shortcomings in this type of system as well. The cables or chains connected to the model eyewear can break or become tangled from customer handling. Tangled cables and chains prevent customers from fully accessing the model eyewear and make the display space look unattractive. Cables or chains attached to eyewear also interfere with the customer's ability to try on the eyewear comfortably. Sometimes cables or chains are removed by personnel to allow a customer to try on a product, which reduces the effectiveness of the security system.

SUMMARY OF THE INVENTION

The disclosure concerns implementing systems and methods for operating a security tag. The methods comprise: disposing a portion of an article (e.g., optical wear) between at least a first pad and a second pad of the security tag; applying a compressive force to the portion of the article disposed between the first and second pads; and concurrently providing by the first and second pads (A) a non-slip grip on the portion of the article and (b) prevention of article staining caused by at least one of oxidization, a chemical interaction, and outgassing.

In some scenarios, the article staining is at least partially prevented by using the first and second pads which comprise a ThermoPlastic Vulcanizates ("TPV") material (e.g., Santoprene™). The first and second pads area adhered to a housing of the security tag via a double-sided tape or other adhesive means.

In those or other scenarios, the article staining is at least partially prevented by allowing gasses released from an outgassing material to pass through at least one channel formed between the first and second pads and be released into a surrounding environment. The channel is formed by a plurality of protrusions extending out and away from the first or second pad. At least two of the plurality of protrusions have the same shape or different shapes.

In some cases, the channel is formed by a first plurality of protrusions extending out and away from the first pad and a second plurality of protrusions extending out and away from the second pad. The first and second plurality of protrusions may comprise the same or different numbers of protrusions.

DESCRIPTION OF THE DRAWINGS

The present solution will be described with reference to the following drawing figures, in which like numerals represent like items throughout the figures.

DETAILED DESCRIPTION

Figure 1:
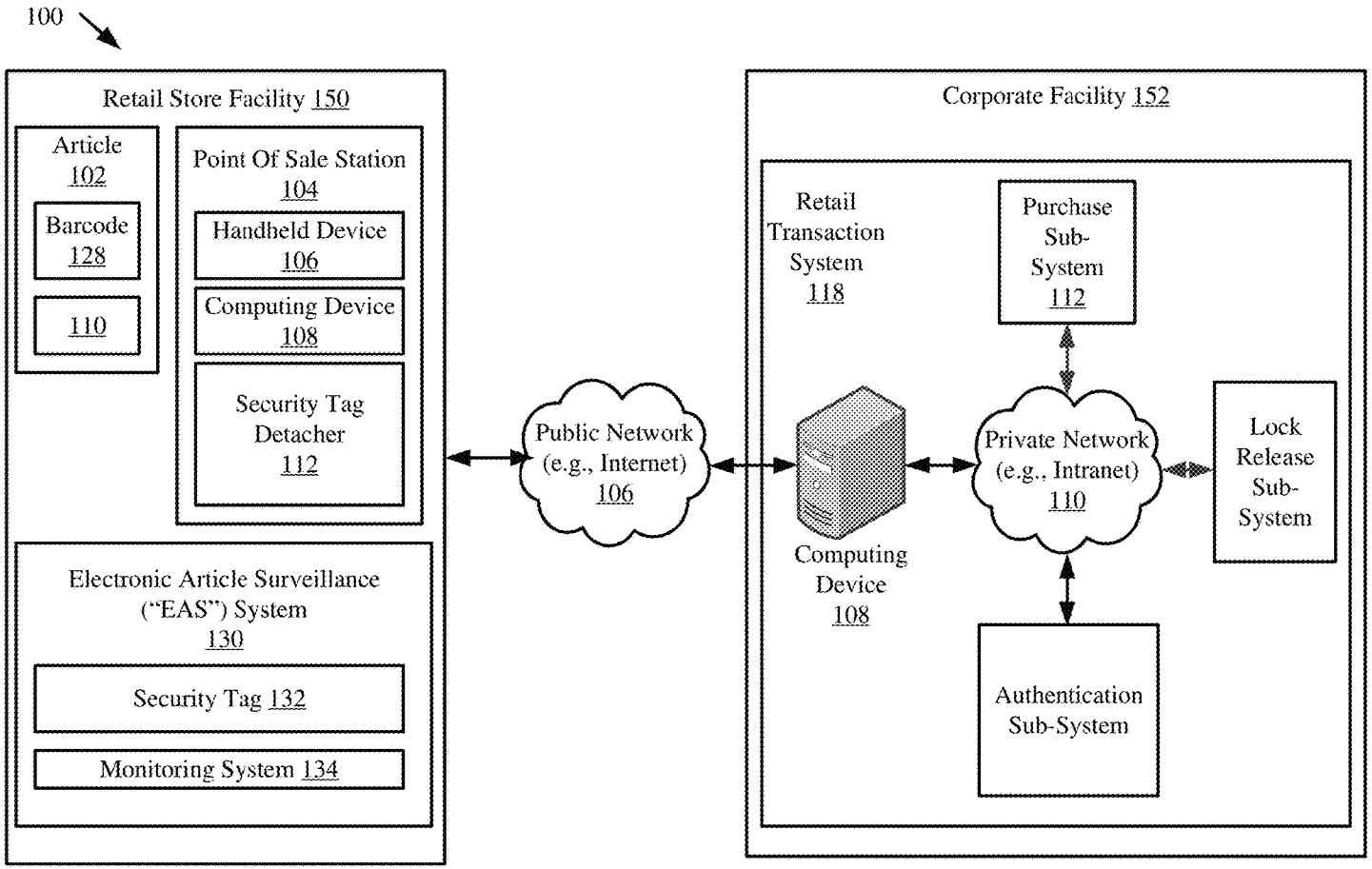
FIG. 1 is a schematic illustration of an illustrative system.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout the specification may, but do not necessarily, refer to the same embodiment.

Furthermore, the described features, advantages and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment", "an embodiment", or similar language means that a particular feature, structure, or characteristic described in connection with the indicated embodiment is included in at least one embodiment of the present invention. Thus, the phrases "in one embodiment", "in an embodiment", and similar language throughout this specification may, but do not necessarily, all refer to the same embodiment.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

There are many security tags known in the art for eyewear. One such security tag is described in U.S. patent application Ser. No. 14/548,585 filed Nov. 20, 2014 entitled "SECURITY TAG." This security tag is referred to herein as the '585 security tag. The '585 security tag can include a detectable sensor, such as an EAS marker and/or an RFID sensor. The '585 security tag allows customers to handle and try on eyewear without interference therefrom. The '585 security tags can be easily attached and detached from the eyewear by one or more authorized persons (e.g., store personnel).

The '585 security tag is generally configured to be attached to a side frame or temple of optical wear such that the security tag do not interfere with the wearers' vision. Parallel soft pads (usually formed of a flexible plastic material) are provided along with a securement mechanism of the security tag so as to minimize any damage to the side frame or temple of the optical wear to which a compression force is being applied by the securement mechanism. The securement mechanism is designed to apply a compression force which is effective for any frame or temple thickness.

However, it has been observed that conventional security tags (such as the '585 security tag), which use a plastic or rubber material for the soft pads, cause staining of the eyeglass stems or temples at the point where the eyeglass stems or frame contact the pads. This staining may be caused by (1) oxidization, (2) chemical interactions between the pad material and the eyewear material, and/or (3) outgassing from pad material and/or eyewear material.

It is well known in the relevant industries that most plastics and rubbers are made from petroleum (oil or natural gas), and can contain a chemical additives. These additives are usually not chemically bonded to the polymer, but are merely mixed into the plastic or rubber during its formulation. Over time, the additives leach out of the plastic or rubber material in a process known as outgassing. The outgassing from the eyewear material normally disperses. However, the plastic/rubber pad material used in the conventional security tags traps the gas released from the pad/eyewear on the surface of the eyewear, thereby causing staining of the eyewear.

Therefore, there exists a need for an improved EAS security system for optical wear and other articles that not only (1) allow customers to handle and try on the same without interference from the security tag and (2) can be easily attached and detached therefrom by one or more authorized persons (e.g., store personnel), but also (3) do not cause or contribute to the staining of the optical wear or other articles. Accordingly, the present disclosure concerns improved security tags for eyeglass frames, finished eyeglasses, sunglasses, reading glasses, goggles, protective eyewear and other types of articles having similar needs or attributes. In the optical wear scenarios, the security tags are generally configured to be attached to a side frame or temple of optical wear such that the security tags do not interfere with the wearers' vision.

Parallel soft pads are provided along with a securement mechanism of each security tag so as to minimize any damage to the side frame or temple of the optical wear to which a compression force is being applied by the securement mechanism. The securement mechanism is designed to apply a compression force which is effective for any frame or temple thickness. The pads are designed so that the eyewear is gripped in a manner that does not allow slipping of the security tag off of the eyewear. In this regard, the pads are formed of a material that has a non-slip gripping feature.

At least one of the pads may also have a plurality of features (e.g., protrusions) designed to provide traction for preventing slippage of the EAS security system off of any frame or temple. The features can be spaced apart from each other so as to create channels for facilitating the ventilation of outgasses from the pad material and/or eyewear material. Notably, the channels alone are not enough to prevent staining of the eyewear since at least a portion of the pad material directly contacts the eyewear frame to provide the requisite compression force. Therefore, the pads are additionally formed from a new material.

Notably, the novel pads of the present solution are not a slight structural change to security tags. In this regard, it should be understood that stain prevention is a significant additional feature for eyewear security tags, which is not easily or customarily achieved by those skilled in the art. Significant research and development was performed by the present inventors to obtain security tags with such a stain prevention feature to support the project at hand: security tags which do not stain eyewear being protected thereby. The stain prevention was achieved by employing a new material for the pads, namely a ThermoPlastic Vulcanizates ("TPV") material.

TPVs are part of the ThermoPlastic Elastomer ("TPE") family of polymers, but are closest in elastomeric properties to Ethylene Propylene Diene Monomer ("EPDM") thermoset rubber, combining the characteristics of vulcanized rubber with the processing properties of thermoplastics. TPV is a dynamically vulcanized alloy consisting mostly of fully cured EPDM rubber particles encapsulated in a PolyPropylene ("PP") matrix.

Stain prevention of the TPV pads is an unexpected result. In this regard, it should be understood that TPVs are typically used in automotive, industrial and demanding consumer applications for flexible engineered parts which require long term performance. Others have recognized the following benefits of using TPVs to replace thermoset rubber in these listed applications: reduce part weight and cost; increase reliability of part performance; and improve manufacturing efficiencies. However, others have not recognized the advantages or desirable features of a security tag resulting from solid or channeled TPV pads. In fact, the inventors assert that a security tag with a stain prevention feature is a surprising and unexpected result of a TPV implementation. For example, it is surprising and unexpected that staining does not occur when solid TPV pads are used in security tags to protect eyewear formed of outgassing materials.

A TPV material which is suitable for use in the present solution is produced and sold by the Exxon Mobile Corporation under the brand name Santoprene™. Santoprene™ is designed specifically for use in medical and healthcare applications, and not for consumer good protection applications. Still, the inventors considered this material during the research and development for security tag applications, and found surprising advantages associated with its use as a pad material.

Notably, in some scenarios, the security tags of the present solution further implement a one-click application method for enabling their attachment to articles. The one-click application method eliminates the human factor which during attachment may make the security tag easy to defeat due to insufficient compression force or otherwise make the security tags inoperable due to excessive compression force. The security tags also have a one-piece design, thus ensuring easy handling and less inventory management thereof. Known magnetic detachers can be used to detach the security tags from the articles.

Figure 2:
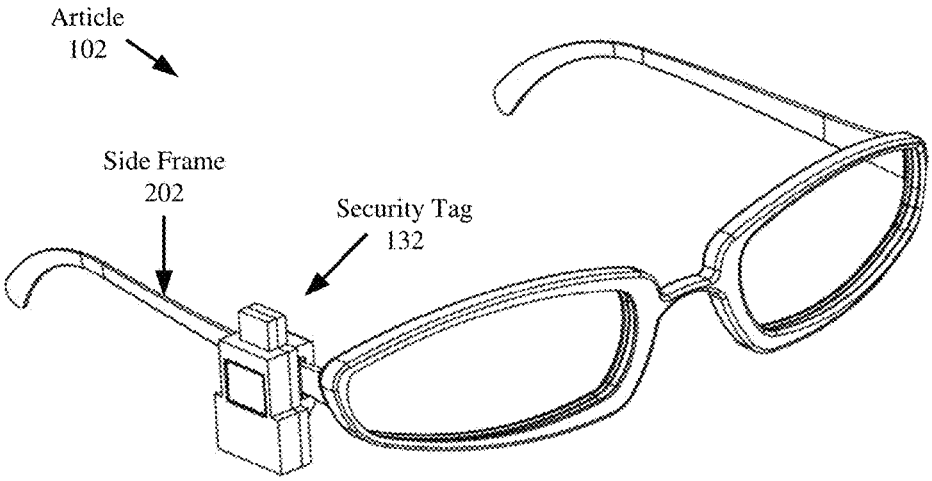
FIG. 2 is a front perspective view of a piece of optical wear with a security tag attached thereto.

Referring now to FIG. 1, there is provided a schematic illustration of an illustrative system 100. System 100 comprises a retail store facility 150 including an EAS 130. The EAS 130 comprises a monitoring system 134 and at least one security tag 132. Although not shown in FIG. 1, the security tag 132 is attached to article 102, thereby protecting the article 102 from an unauthorized removal from the retail store facility 150. A schematic illustration of the security tag 132 attached to an article 102 is provided in FIG. 2. As shown in FIG. 2, the article can include, but is not limited to, optical wear. The monitoring system 134 establishes a surveillance zone (not shown) within which the presence of the security tag 132 can be detected. The surveillance zone is established at an access point (not shown) for the retail store facility 150. If the security tag 132 is carried into the surveillance zone, then an alarm is triggered to indicate a possible unauthorized removal of article 102 from the retail store facility 150.

During store hours, a customer (not shown) may desire to purchase the article 102. The customer can purchase the article 102 using a Point Of Sale ("POS") station 104. The POS station 104 can include, but is not limited to, a traditional fixed Point Of Sale ("POS") station (e.g., a checkout counter) or a mobile POS station. In either scenario, a retail transaction application executing on a computing device 108 of the POS station 104 facilitates the exchange of data between the article 102, security tag 132, customer, store associate (not shown) and/or Retail Transaction System ("RTS") 118 of a corporate facility 152. For example, after the retail transaction application is launched, a store associate is prompted to start a retail transaction process for purchasing the article 102. The retail transaction process can be started simply by performing a user software interaction, such as depressing a key on a keypad of the computing device 108 or touching a button on a touch screen display of the computing device 108.

Subsequently, the store associate may manually input into the retail transaction application article information. Alternatively or additionally, the store associate may place a handheld device 106 of the POS station 104 in proximity of article 102. As a result of this placement, the POS station 104 obtains article information from the article 102. The article information includes any information that is useful for purchasing the article 102, such as an article identifier and an article purchase price. In some scenarios, the article information may even include an identifier of the security tag 132 attached thereto. The article information can be communicated from the article 102 to the handheld device of the POS station 104 via a short range communication, such as a barcode communication or a Near Field Communication ("NFC").

In the barcode scenario, article 102 has a barcode 128 attached to an exposed surface thereof. The term "barcode", as used herein, refers to a pattern or symbol that contains embedded data. Barcodes may include, for example, one-dimensional barcodes, two dimensional barcodes (such as matrix codes, Quick Response ("QR") codes, Aztec codes and the like), or three-dimensional bar codes. The embedded data can include, but is not limited to, a unique identifier of the article 102 and/or a purchase price of article 102. The barcode 128 is read by a barcode scanner/reader (not shown in FIG. 1) of the POS station 104. Barcode scanners/readers are well known in the art. Any known or to be known barcode scanner/reader can be used herein without limitation.

In the NFC scenarios, article 102 may comprise an NFC enabled device 110. The NFC enabled device 110 can be separate from security tag 132 or comprise security tag 132. An NFC communication occurs between the NFC enabled device 110 and the handheld device 106 over a relatively small distance (e.g., N centimeters or N inches, where N is an integer such as twelve). The NFC communication may be established by touching components 102, 106 together or bringing them in close proximity such that an inductive coupling occurs between inductive circuits thereof. In some scenarios, the NFC operates at 13.56 MHz and at rates ranging from 106 kbit/s to 848 kbit/s. The NFC may be achieved using NFC transceivers configured to enable contactless communication at 13.56 MHz. NFC transceivers are well known in the art, and therefore will not be described in detail herein. Any known or to be known NFC transceivers can be used herein without limitation.

After the POS station 104 obtains the article information, payment information is input into the retail transaction application of POS station 104. In response to the reception of the payment information, the POS station 104 automatically performs operations for establishing a retail transaction session with the RTS 118. The retail transaction session can involve: communicating the article information and payment information from the POS station 104 to the RTS 118 via a public network 106 (e.g., the Internet); completing a purchase transaction by the RTS 118; and communicating a response message from the RTS 118 to the POS station 104 indicating that the article 102 has been successfully or unsuccessfully purchased. The purchase transaction can involve using an authorized payment system, such as a bank Automatic Clearing House ("ACH") payment system, a credit/debit card authorization system, or a third party system (e.g., PayPal®, SolidTrust Pay® or Google Wallet®).

The purchase transaction can be completed by the RTS 118 using the article information and payment information. In this regard, such information may be received by a computing device 108 of the RTS 118 and forwarded thereby to a sub-system of a private network 100 (e.g., an Intranet). For example, the article information and purchase information can also be forwarded to and processed by a purchase sub-system 112 to complete a purchase transaction. When the purchase transaction is completed, a message is generated and sent to the POS station 104 indicating whether the article 102 has been successfully or unsuccessfully purchased.

If the article 102 has been successfully purchased, then a security tag detaching process can be started. During the security tag detaching process, a security tag detacher 112 of the POS station 104 is used to cause actuation of a detaching mechanism of the security tag 132. Once the security tag 132 has been detached from article 102, the customer 140 can carry the article 102 through the surveillance zone without setting off the alarm.

Figure 3:
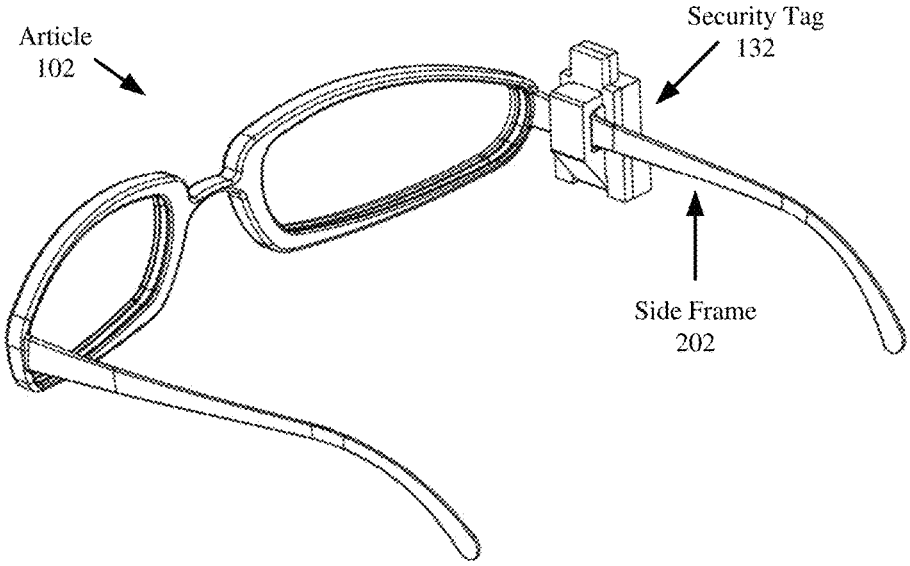
FIG. 3 is a rear perspective view of a piece of optical wear with a security tag attached thereto.
Figure 5:
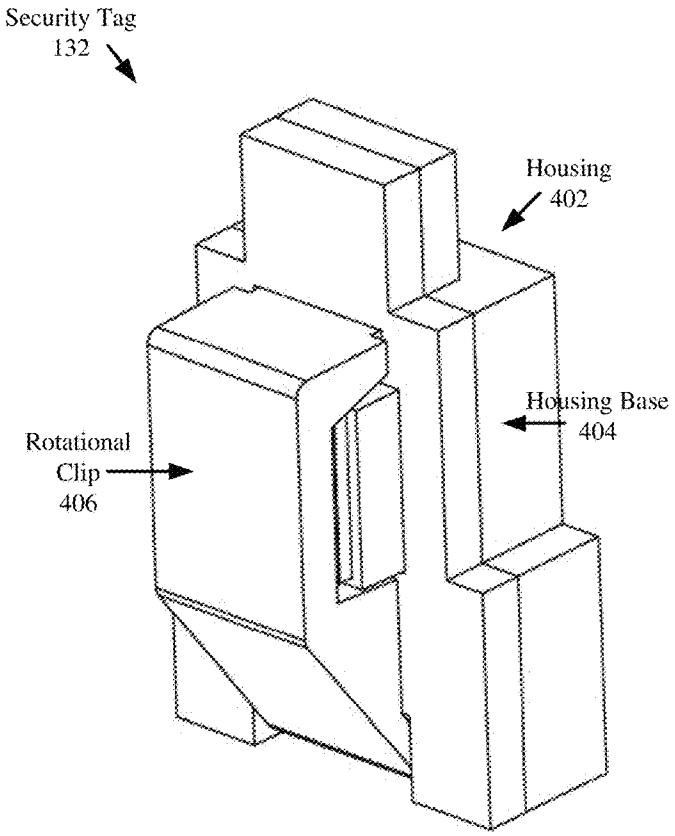
FIG. 5 is a rear perspective view of the security tag shown in FIGS. 2-4.
Figure 4:
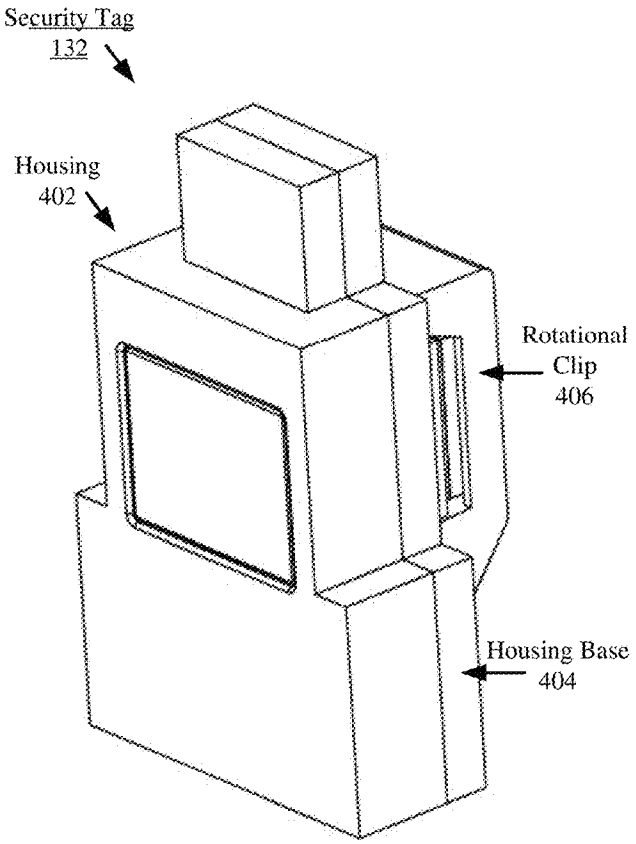
FIG. 4 is a front perspective view of the security tag shown in FIGS. 2-3.

Referring now to FIGS. 2-3, there are provided schematic illustrations of the security tag 132 attached to an article 102. As noted above, the article 102 can include, but is not limited to, optical wear. As such, the security tag 132 will be described below in relation to glasses. However, the present solution is not limited in this regard. The security tag 132 can be used with other types of articles that have a linear member which can be clamped between two opposing clamp surfaces of the security tag. In all scenarios, the security tag 132 is generally designed to be removably coupled to the article, without causing damage thereto (e.g., by not exerting excessive pressure or compression force thereon).

More detailed schematic illustrations of the security tag 132 are provided in FIGS. 4-7. As shown in FIGS. 4-7, the security tag 132 comprises a housing 402. The housing 402 can be formed from any suitably material, such as plastic (e.g., which may have been injection molded). The material from which the housing 402 is formed may be transparent or opaque. However, there are certain advantages to using transparent materials for the housing 402. For example, transparent materials facilitate the minimization of any obstruction of the article's appearance by the security tag 132.

The housing 402 has a housing base 404 and a rotational clip 406. The housing base 404 is formed of a back cover 606 and a front cover 608, which may be ultrasonically welded together during assembly of the security tag 132. Covers 606 and 608 collectively define insert spaces 632, 640, 646, 652 in which various components of the security tag 132 are housed.

Figure 6:
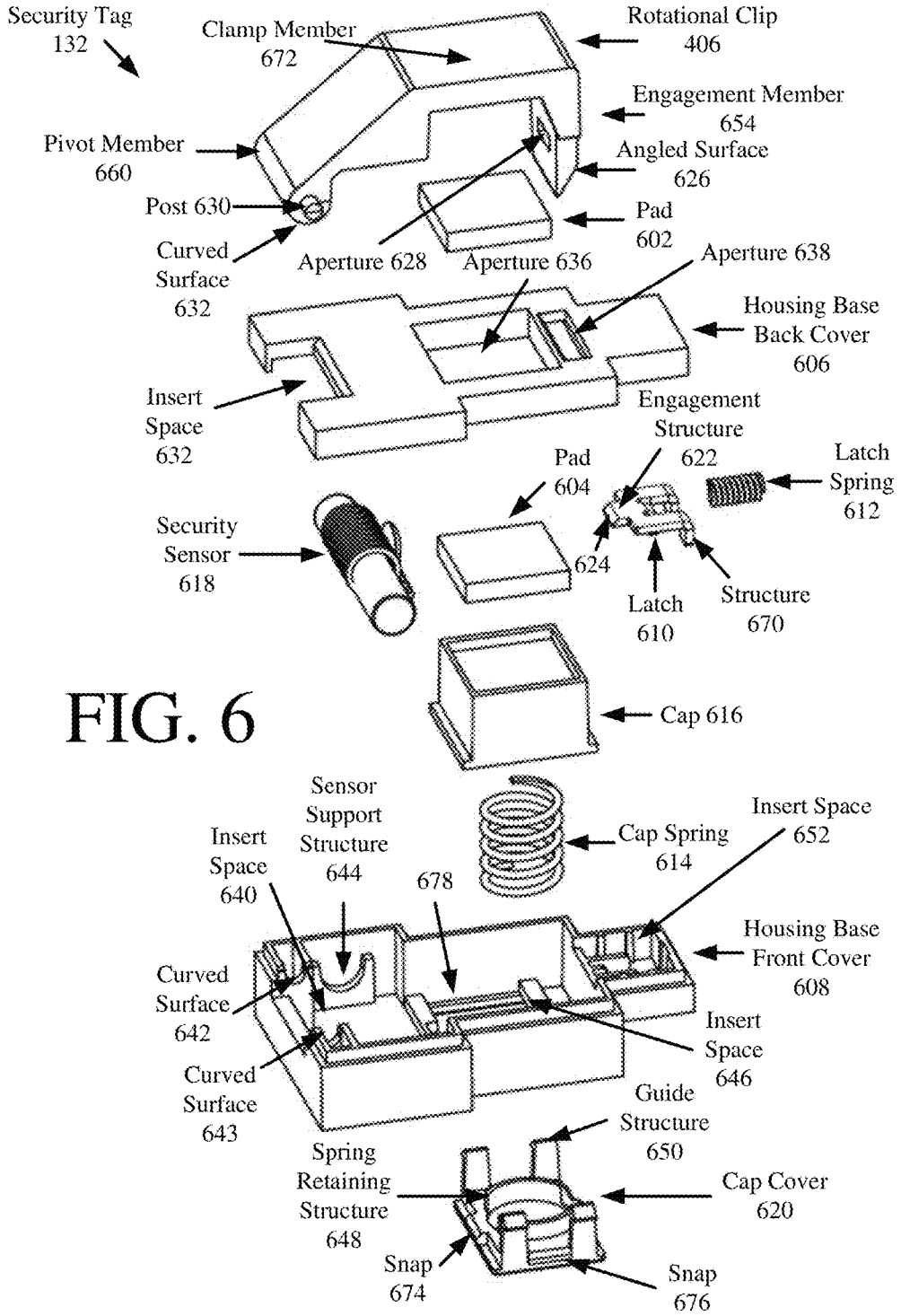
FIG. 6 is an exploded view of the security tag shown in FIGS. 2-5.
Figure 7:
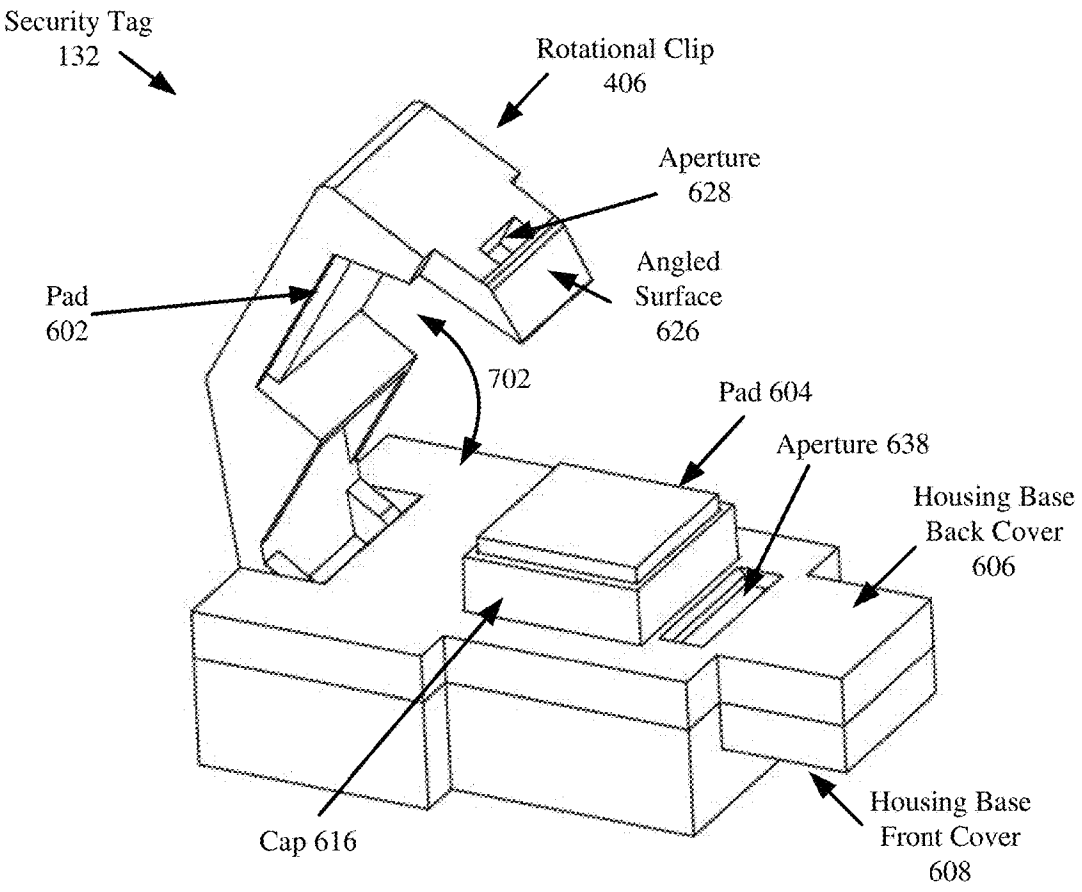
FIGS. 7-9 provide schematic illustrations that are useful for understanding operations of the security tag shown in FIGS. 2-6.
Figure 8:
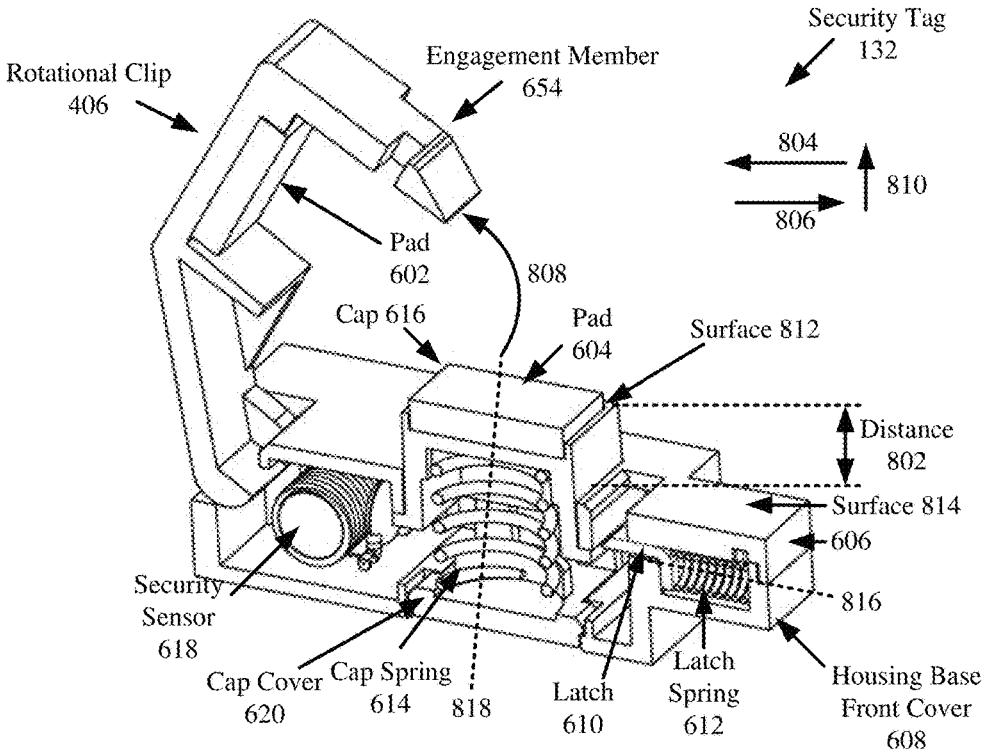
Figure 9:
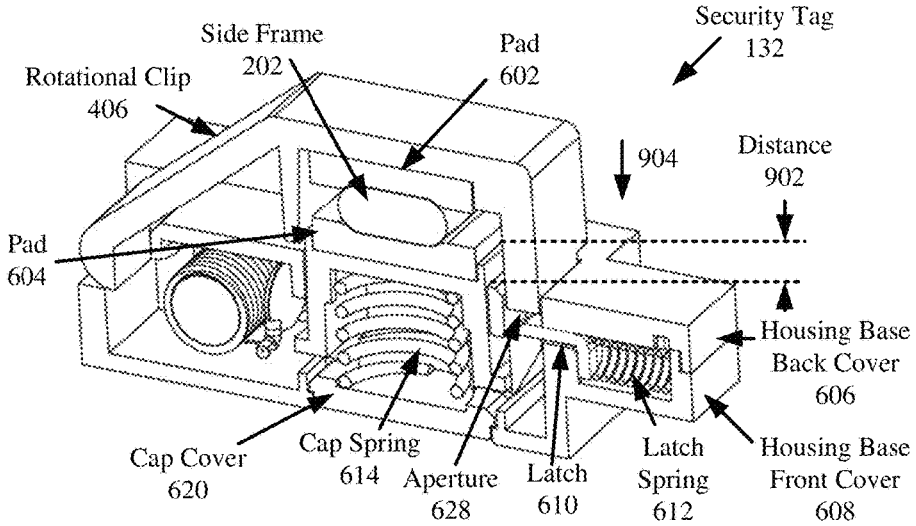

In some scenarios, one or more security sensors 618 is(are) disposed within the housing base 404 (as shown in FIGS. 6, 8 and 9) and/or rotational clip 406. Security sensors are well known in the art, and therefore will not be described herein. Any known or to be known security sensors can be used herein without limitation. Still, it should be understood that the security sensor provides a way to detect when an article is being removed from a particular area by an unauthorized person or in an unauthorized manner (e.g., without being purchased). As such, the security label includes a sensor operable with EAS technology. Such sensors can include, but are not limited to, an NFC sensor and/or an RFID sensor. The security sensor may be configured to provide an audible, visual and/or tactile alarm when it passes into the surveillance zone of an EAS system. Also, the security label may comprise a passive device, an active device and/or a hybrid passive/active device. A support structure (e.g., structure 644) may be provided to retain and/or maintain the security sensor in a particular position within the housing base 404 and/or rotational clip 406.

The rotational clip 406 is pivotally mounted on the housing base 404. As such, the rotational clip 406 can be rotated towards and away from the back cover 606 of the housing 402, as shown by bi-directional arrow 702 of FIG. 7. For example, the rotational clip 406 may be rotated away from the back cover 606 when an article is to be disposed within the security tag 132 and/or when the security tag is to be decoupled from the article. In contrast, the rotational clip 406 may be rotated towards the back cover 606 such that the rotational clip 406 can be locked in its closed position, whereby the article is securely coupled to the security tag 132.

As shown in FIG. 6, the pivotal movement of the rotational clip 406 is facilitated by a pivot member 660. Pivot member 660 comprises at least one post 630 and a curved surface 632. When assembled, the pivot member 660 resides within insert space 632, while the post(s) 630 reside(s) between the front and back covers 606, 608 within an insert space 640. Each post is generally circular in shape such that it can be supported by a curved surface 642 or 643 of a sidewall defining insert space 640, as well as be rotated thereon.

The locking of the rotational clip 406 in its closed position is facilitated by an engagement member 654 thereof. The engagement member 654 comprises an aperture 628 and an angled surface 626. When the rotational clip 406 is moved towards the back cover 606, the engagement member 654 travels through an aperture 638 formed in the back cover 606. Thereafter, the angled surface 626 of the engagement member 654 engages an angled surface 624 of a latch 610. The angled surface 626 slides along angled surface 624 as the rotational clip 406 is further moved in a direction towards the back cover 606. This sliding movement causes the latch 610 to compress a latch spring 612. When an engagement structure 622 of the latch 610 becomes aligned with the aperture 628 formed through the engagement member 654 of the rotational clip 406, the latch spring 612 returns to its less compressed state whereby the engagement structure 622 of the latch 610 travels into the aperture 628 so as to lock the rotational clip 406 in its closed position. Notably, the latch 610 and latch spring 612 are disposed in an insert space 652 of the front cover 608. Also, an audible and/or tactile indictor may be generated and output when the rotational clip 406 is locked in its closed position so that the user knows when the article has been securely coupled to the security tag 132.

The rotational clip 406 can be unlocked by the application of a magnetic field to the latch 610 and the latch spring 612. In this regard, the latch and latch spring are formed of a magnetic material, such as metal. As shown in FIG. 6, the latch 610 has two protruding structures 670 with surface areas having a size selected for maximizing a magnetic force when a magnetic field is applied thereto. The magnetic field causes the latch spring 612 to transition from its less compressed state to its further compressed state, whereby the latch 610 is removed from the aperture 628 of the rotational clip 406. Compressing the rotational clip 406 by the operator to relieve the force from cap spring 614 may be required to allow latch 610 to travel under the magnetic force. At this time, the rotational clip 406 can be rotated away from the housing base's back cover 606.

The article 102 is retained between the housing base 404 and the rotational clip 406 via a frictional force and a compression force that is applied thereto. The frictional force is applied to the article 102 via two pads 602 and 604 if the article is pulled. In this regard, the pads are both formed of a frictional material, such as TPV material. During use, the article 102 cannot be removed from the locked security tag 132 by an unauthorized person since (s)he is unable to apply a load to the article 102 that is sufficient to overcome at least the frictional force applied by the pads 602, 604. Notably, the pads 602 and 604 have a plurality of purposes: (1) providing said frictional force when the security tag is being used; (2) ensuring that the article is not damaged by the security tag when clamped therein; and (3) ensuring that the article is not stained as a result of being clamped therein.

The compression force is applied to the article 102 by the rotational clip 406 and a cap 616 when the security tag 132 is in its locked position. In this regard, it should be understood that the cap 616 is a spring-loaded cap that can move in two opposing directions represented by arrows 810 of FIG. 8 and 904 of FIG. 9. The spring-loaded cap is assembled by: securing the cap 616 in an insert space 646 formed between the front and back covers 608, 606; disposing a cap spring 614 within insert space 646 after the front and back covers have been attached to each other (e.g., by an ultrasonic weld); and securely coupling a cap cover 620 to the front cover 608. The cap spring 614 comprises at least one stop structure thereon which prevents the cap from being dislodged from the housing base by the cap spring 614. The housing base may additionally or alternatively include a stop structure for the same purpose. The cap spring 614 has a force selected in accordance with a particular application. The greater the force, the greater the security level. Notably, the cap spring 614 is normally biased towards the cap 616. As such, the pad 604 is spring-biased towards the pad 602 during use of the security tag 132. When the security tag 132 is in use, the pads 602 and 604 are aligned with each other so that the article 102 resides therebetween.

The cap cover 620 acts as a fixed, unmovable structure for (1) retaining the cap spring 614 within insert space 646 and (2) maintaining the cap spring 614 in alignment with the cap 616. The first function (1) is facilitated by guide structures 650 and snap structures 674, 676. The guide structures 650 enable (1) proper alignment of the cap cover 620 when being assembled with the front cover 608 and (2) facilitate secure, unmovable coupling of the cap cover 620 with the front cover 608. The snap structures 674, 676 provide secure coupling mechanisms which snap into place when the cap cover 620 is pressed towards the front cover 608. In this regard, each snap structure 674, 676 snappingly engages an engagement structure 678 formed on an inner surface of the front cover 608.

Figure 23:
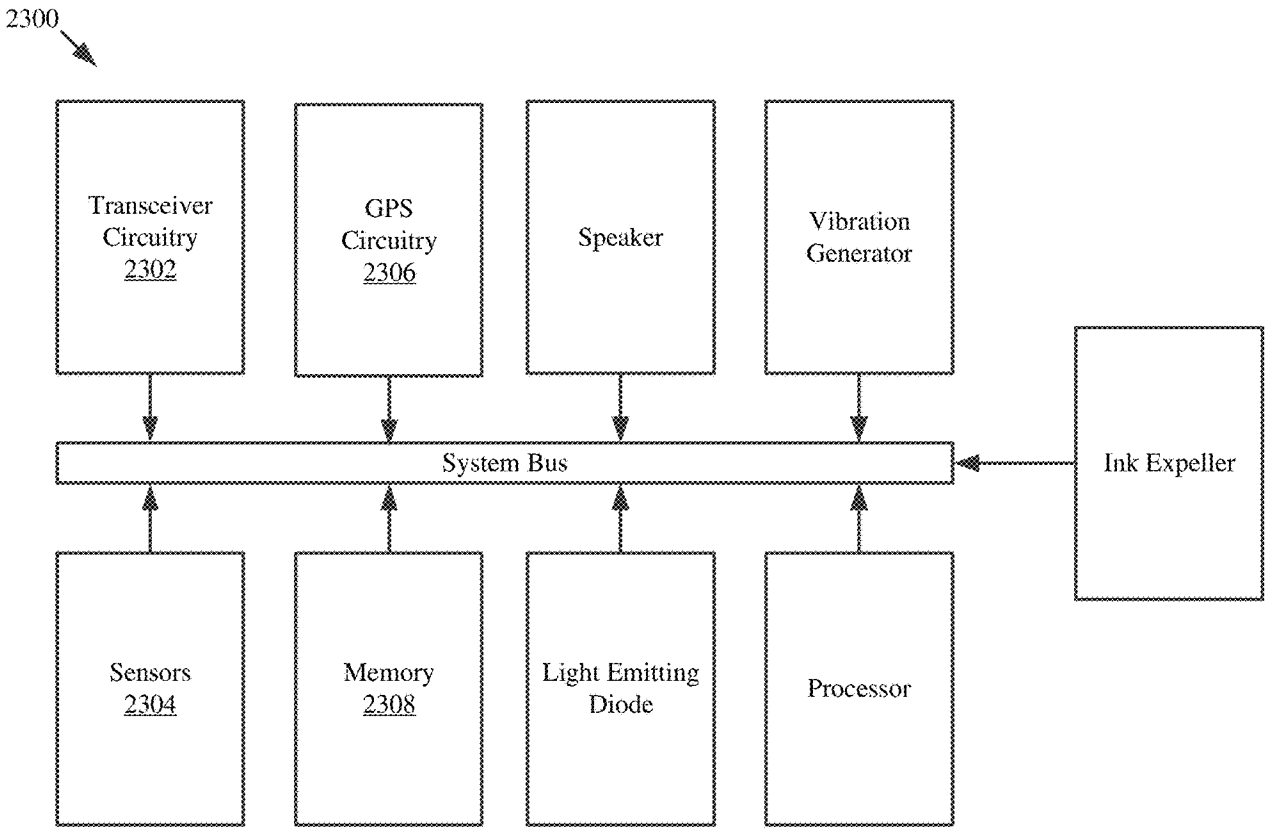
FIG. 23 is a flow diagram of an exemplary method for protecting an article using a security tag.

In some scenarios, the security tag 132 is designed to expel ink when a sensor (e.g., sensor 2304 of FIG. 23) thereof detects an attempt to break the rotational clip 406, detects that the rotational clip 406 has been broken or bent, detects that an attempt has been made to disengage/decouple the rotational clip 406 from the housing base 404, and/or detects an attempt to pull the frame 202 out of the security tag 132. Various audio (e.g., an alarm), visual (e.g., light) and/or tactile indicators (e.g., vibration) can also be output from the security tag 132 when an unauthorized attempt is made to remove the security tag from the article, or from a particular geographic location. Sensor information, audio/visual/tactile indicator information, and/or geographic location information may be communicated from the security tag to a remote communication device (e.g., a mobile or stationary point of sale device 106, 108 of FIG. 1, or a mobile device of a store employee) so as to (1) immediately inform a store associate that an unauthorized attempt to remove the security tag from an article is occurring or has just occurred at a certain location in the facility and/or (2) continuously or periodically inform the store associate as to the location of the security tag. As such, the security tag can include internal circuitry (e.g., circuitry 2300 of FIG. 23) such as GPS circuitry (e.g., GPS circuitry 2306 of FIG. 23), transceiver circuitry (e.g., transceiver circuitry 2302 of FIG. 23), and memory (e.g., memory 2308 of FIG. 23). Communication of this information may be triggered upon the detection of an attempt to cut or break the rotational clip 406, an attempt to cut or break the frame 202, and/or an attempt has been made to disengage/decouple the rotational clip 406 and/or frame 202 from the security tag 132.

Referring now to FIG. 8, there is provided a cross-sectional view of the assembled security tag 132 in its unlocked (or open) position. As shown in FIG. 8, the rotational clip 406 is rotated away from the housing base 404, as shown by arrow 808. In effect, the latch 610 does not engage the engagement member 654 of the rotational clip 406. Also, the cap 616 and pad 604 are spring-biased in a direction 810 away from the housing base's back cover 606. In this regard, it should be understood that the cap spring 614 is normally in its less compressed state, whereby a distance 802 exists between a surface 812 of the cap 616 and a surface 814 of the housing base's back cover 606. The latch spring 612 is also normally in its less compressed state.

Referring now to FIG. 9, there is provided a cross-sectional view of the assembled security tag 132 in its locked (or closed) position. As shown in FIG. 9, the rotational clip 406 is rotated towards the housing base 404 such that the latch 610 engages the engagement member 654 of the rotational clip 406. A side frame 202 of an article 102 is clamped between pads 602 and 604. In this regard, it should be understood that the cap 616 and pad 604 are still spring-biased in a direction 810 away from the housing base's back cover 606. However, the cap spring 614 is in a further compressed state. In effect, the distance between the surface 812 of the cap 616 and the surface 814 of the housing base's back cover 606 has been reduced, as shown by reference numbers 802 and 902.

Notably, the pads 602 and 604 are formed of a TPV material. The TPV material provides a non-slip grip on to an article when compressed between the two pads 1002, 1004. Utilizing a TPV material as the pad material advantageously prevents staining of the eyeglass frames or stems as a result of oxidization, outgassing and/or chemical interaction.

Extensive testing has been conducted with various materials, and TPV materials have been found to be well suited for this application.

The TPV pads 602 and 604 are respectively coupled to the rotational clip and cap via an adhesive. The adhesive includes, but is not limited to, glue and/or tape. In some scenarios, a double-sided tape is used to adhere the TPV pads to the tag body. The double-sided tape can include, but is not limited to, a double coasted tape available from 3M of St. Paul, Minn.

Figure 10:
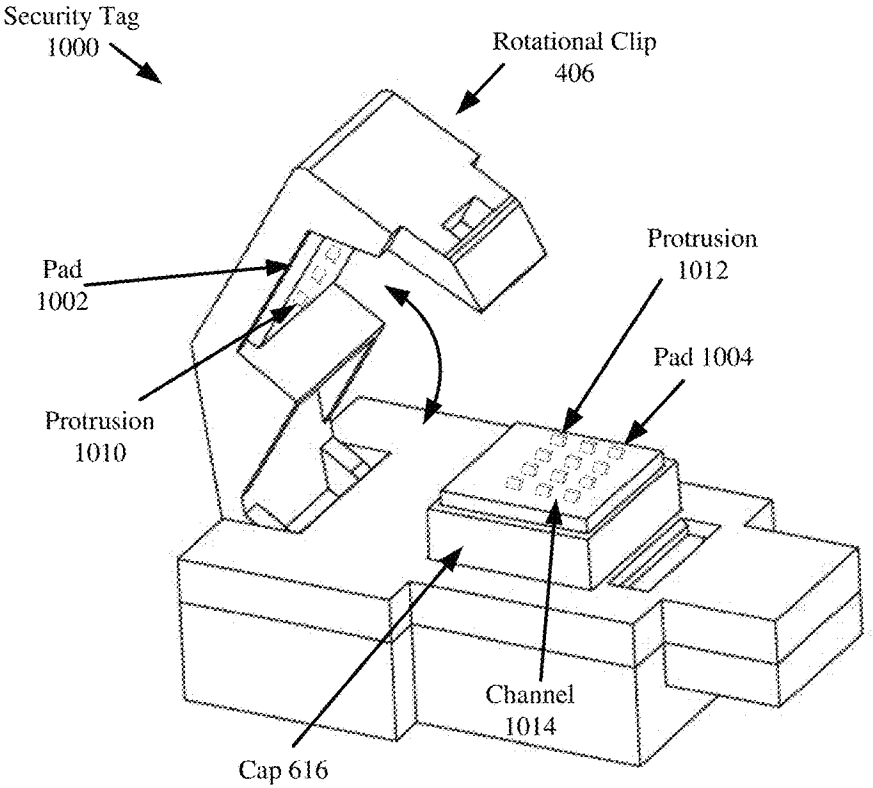
FIG. 10 provides an illustration of a security tag with features for providing traction to prevent slipping of security tag off item.

Referring now to FIG. 10, there is provided an illustration of a security tag 1000. Security tag 1000 is the same as security tag 132 except for the pads 1002, 1004. The discussion provided above in relation to security tag 132 is sufficient for understanding the remaining components of security tag 1000.

Pads 1002 and 1004 are configured to collectively surround and protect an eyeglass frame, temple or stem from damage while the security tag is coupled thereto. In this regard, pad 1002 is coupled to the rotational clip 406 and pad 1004 is coupled to the cap 616 in a manner that ensures their alignment with each other when the security tag is in its closed position (as shown in FIG. 9). Although two pads are shown in FIG. 10, the present solution is not limited in this regard. Any number of pads can be provided in accordance with a given application.

Pads 1002 and 1004 are designed to prevent staining of eyewear frames when in use to protect the same. Both pads are shown in FIG. 10 has having an inventive configuration which minimizes or eliminates damage which may be caused by oxidization, outgassing and/or chemical interaction. The present solution is not limited in this regard. For example, only one of the pads may be provided with such an inventive configuration.

The pads 1002, 1004 are formed from a TPV material. The TPV material provides a non-slip grip on to an eyewear frame or stem when compressed between the two pads 1002, 1004. Utilizing a TPV material as the pad material advantageously prevents staining of the eyeglass frames or stems as a result of oxidization, outgassing and/or chemical interaction.

The TPV pads are respectively coupled to the rotational clip 1008 and cap 1006 via an adhesive. The adhesive includes, but is not limited to, glue and/or tape. In some scenarios, a double-sided tape is used to adhere the TPV pads to the tag body 1006, 1008. The double-sided tape can include, but is not limited to, a double coated tape available from 3M of St. Paul, Minn.

The pads 1002, 1004 comprise protrusions 1010, 1012 extending out and away therefrom. The same or different number of protrusions can be provided on the pads. For example, as shown in FIG. 10, pad 1002 comprises three protrusions 1010 while pad 1004 comprises twelve protrusions 1012. The present solution is not limited to the particulars of this example.

The protrusions 1010, 1012 are spaced apart from each other by a distance selected in accordance with a particular application. The protrusions 1010, 1012 also have an overall pattern selected for ensuring that: (1) the protrusions 1010 align with respective protrusions 1012 when the security tag 1000 is in its closed position; and/or (2) at least one channel is provided between the two pads 1002, 1004 when the security tag 1000 is in its closed position so that gases expelled by the eyeglass wear material are ventilated from the security tag. The overall pattern can have any shape, such as a rectangular shape (shown on pad 1004 in FIG. 10), a linear shape (shown on pad 1002 in FIG. 10), a circular shape, or a star shape. The channels can have any width selected in accordance with a particular application (e.g., ½ the width of a protrusion).

Figure 11:
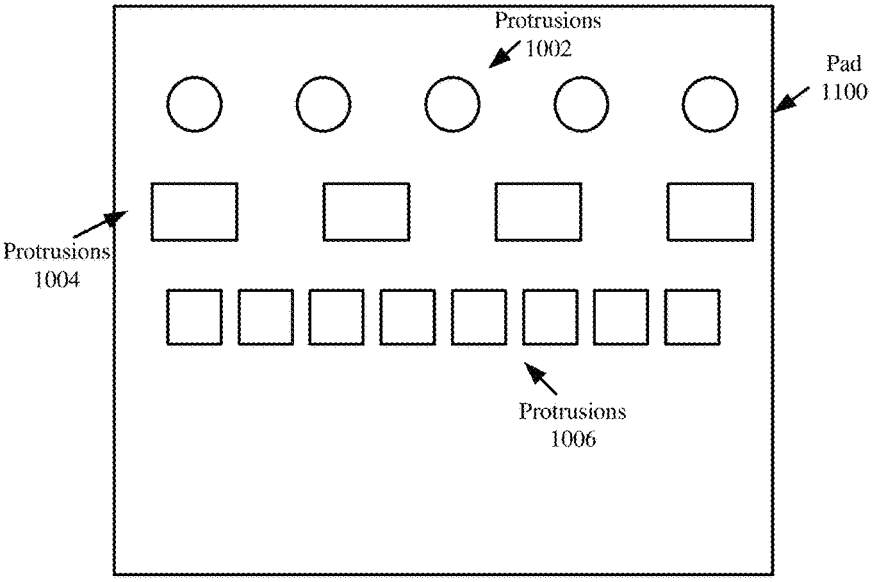
FIG. 11 provides a top view of an illustrative pad with features of various types for providing traction to prevent slipping of security tag off item.
Figure 12:
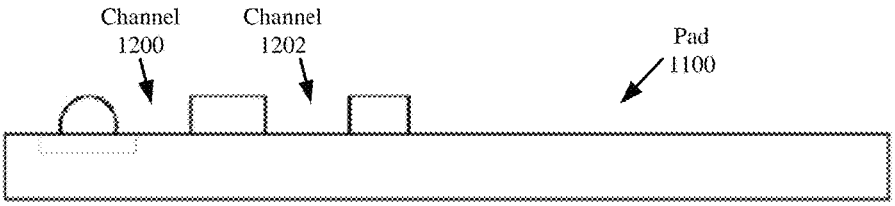
FIG. 12 provides a side view of the pad shown in FIG. 11.
Figure 15:
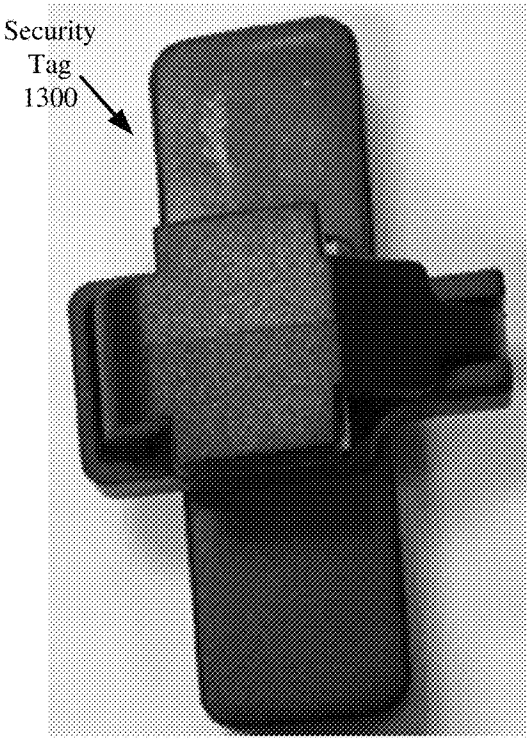
FIGS. 13-20 provide illustrations showing another illustrative security tag.
Figure 14:
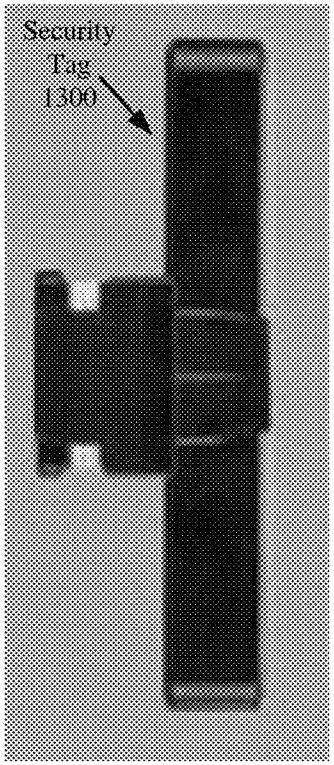
Figure 13:
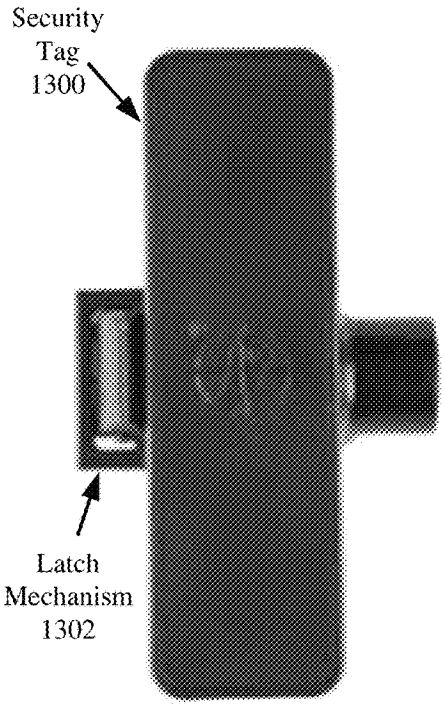
Figure 16:
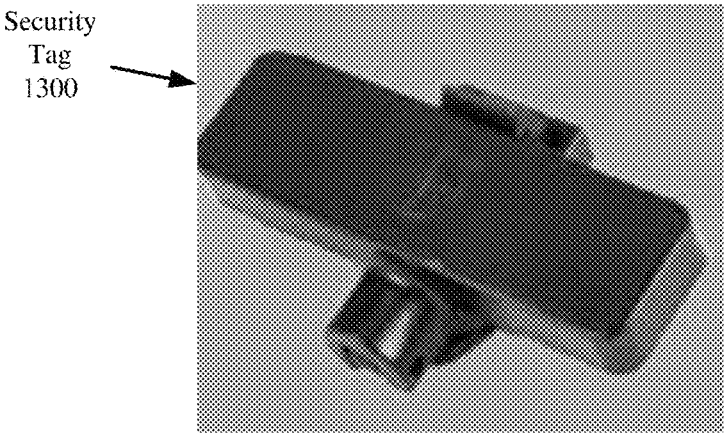
Figure 17:
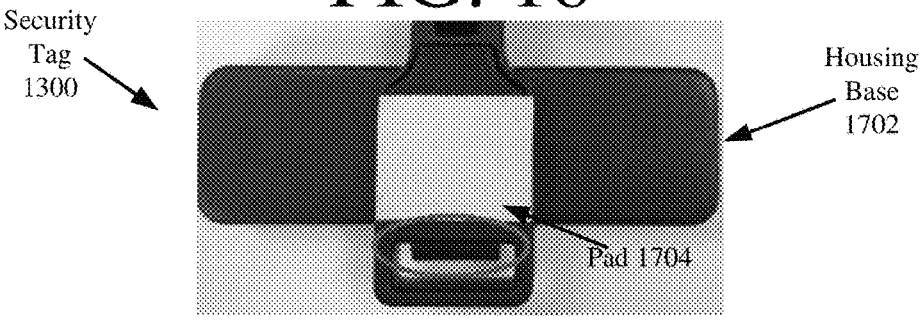
Figure 18:
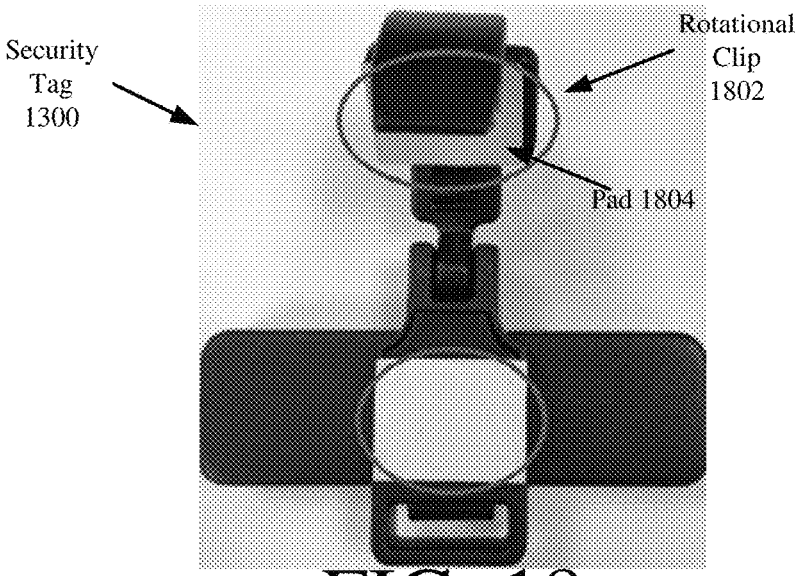
Figure 20:
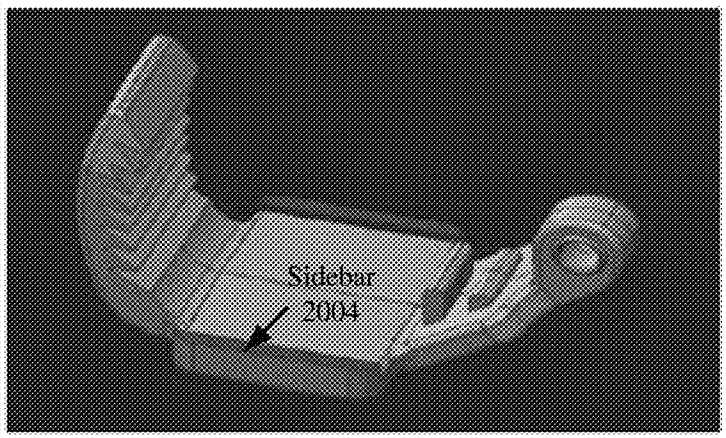
Figure 19:
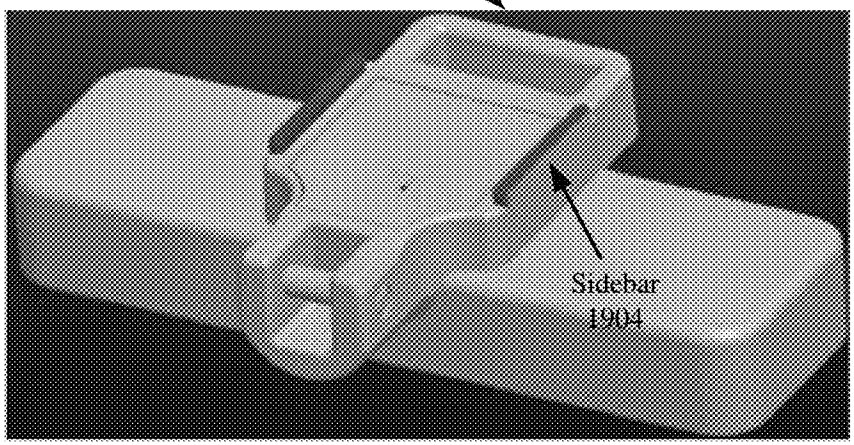
Figure 21:
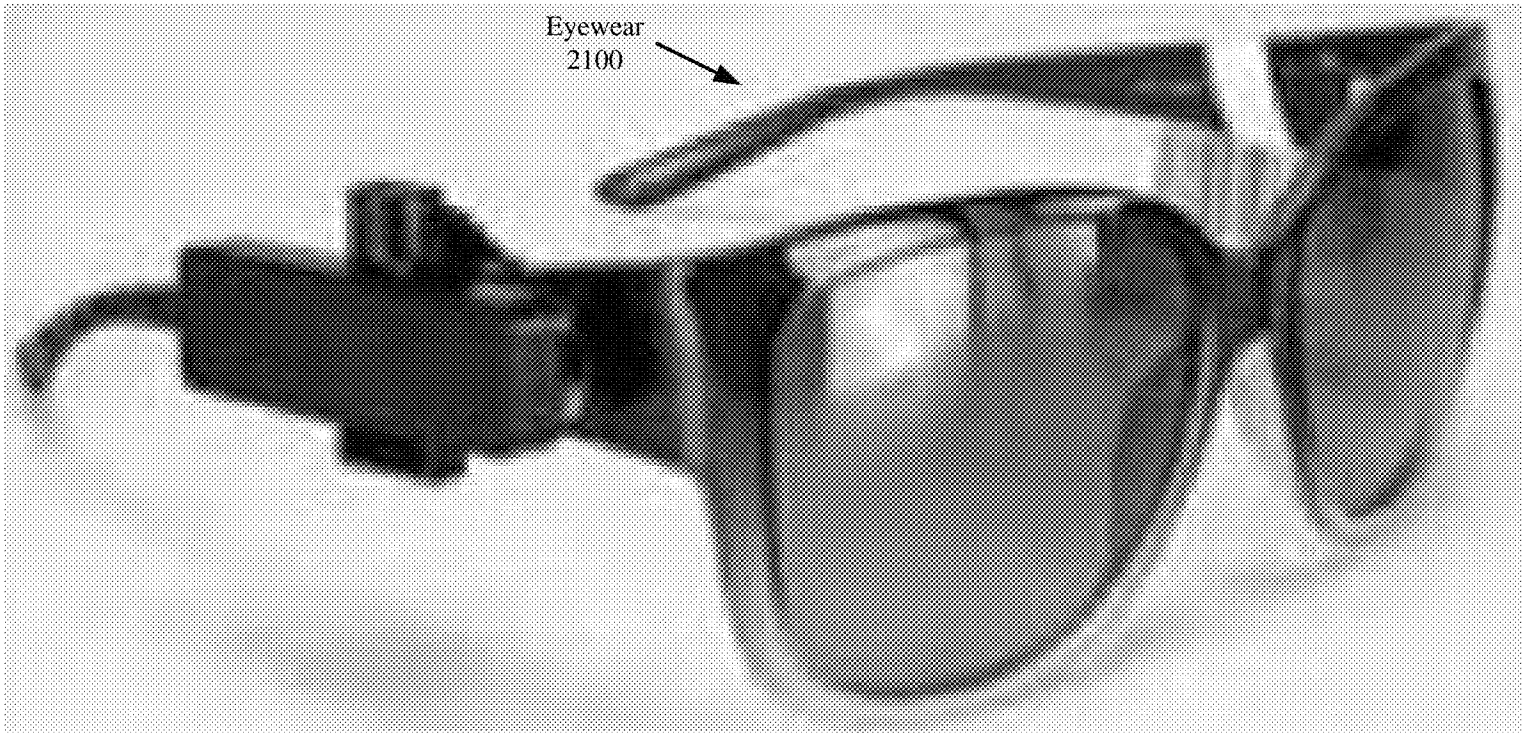
FIG. 21 provides an illustration showing the security tag of FIGS. 13-20 coupled to a piece of eyewear.

In FIG. 10, the protrusions are shown as having generally rectangular shapes. The present solution is not limited in this regard. The protrusions can have any shape, such as a dome shape, a rectangular shape, a triangular shape, a post shape, etc. Also, the protrusions of each group 1010 and 1012 can have the same or different shapes. For example, a pad 1100 comprising three sets of protrusions 1002, 1004, 1006 is shown in FIGS. 11-12. Each set includes a different number of protrusions with different shapes. Five protrusions 1002 have circular shapes. Four protrusions 1004 have rectangular shapes. Eight protrusions 1006 have square shapes. Channels 1200 and 1202 are provided between respective protrusions 1002, 1004, 1006. The present solution is not limited to the particulars of this example.

The present solution is also not limited to the security tag architecture shown in FIGS. 2-10. Any known or to be known security tag architecture can be used herein with the novel pads. For example, another security tag architecture which can employ the novel pads is shown in FIGS. 13-21.

As shown in FIGS. 13-21, the security tag 1300 comprises a rotational clip 1802 and a housing base 1702. A pad 1804 is coupled to the rotational clip 1802. A pad 1704 is coupled to the housing base 1702. Side bars 1904, 2004 are provided to protect the pads.

During use, an eyewear frame or stem is compressed between the pads 1702, 1802. The security tag 1300 is placed in its locked position via a latch mechanism 1302. The latch mechanism 1302 is similar to a zip tie. In this regard, the rotational clip 1802 can be threaded through an end 1902 of the housing base 1702 and tightened so as to fasten the eyewear 2100 to the security tag 1300. A magnetic field can be applied to release the rotational clip 1802 from the housing base 1702.

Figure 22:
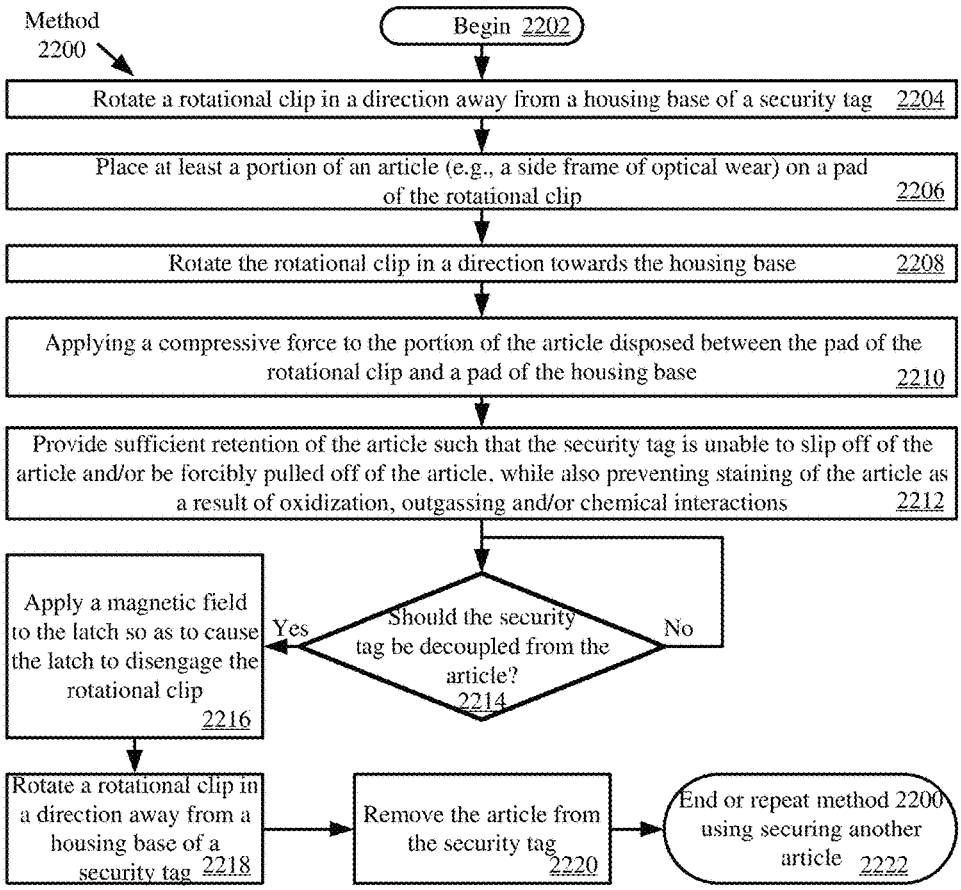
FIG. 22 is a front perspective view of a piece of optical wear with the security tag of FIGS. 13-20 attached thereto.

Referring now to FIG. 22, there is provided an exemplary method 2200 for operating a security tag (e.g., security tag 1000 of FIG. 10) of an EAS system (e.g., EAS system 100 of FIG. 1). Method 2200 begins with step 2202 and continues with step 2204. In step 2204, a rotational clip (e.g., rotational clip 406 of FIGS. 4-10) is rotated in a direction (e.g., direction 808 of FIG. 8) away from a housing base (e.g., housing base 404 of FIGS. 4-10) of the security tag. Once the rotational clip has been rotated a certain distance from the housing base, step 2206 is performed where at least a portion (e.g., side frame 202 of FIG. 2) of an article (e.g., article 102 of FIG. 1) is placed on a pad (e.g., pad 1002 of FIG. 10) of the rotational clip. Notably, another pad is coupled to the housing base and resiliently biased in a direction (e.g., direction 810 of FIG. 8) away from the housing base by a cap spring (e.g., cap spring 614 of FIGS. 4-10). The rotational clip is then rotated towards the housing base, as shown by step 2208.

In next step 2210, the rotational clip is further rotated. More specifically, the rotational clip is further rotated in step 2210 so that a compressive force is applied to the portion of the article disposed between the pad of the rotational clip (e.g., pad 1002 of FIG. 10 or 1804 of FIG. 18) and the pad of the housing base (e.g., pad 1004 of FIG. 10 or 1704 of FIG. 17).

In some scenarios, the compressive force is applied by: rotating the rotational clip until an engagement member (e.g., engagement member 654 of FIGS. 4-10) of the rotational clip contacts a latch disposed within the housing base, where the article resides between two pads (e.g., pads 1002 and 1004 of FIG. 10) respectively coupled to the rotational clip and the housing base; sliding an angled surface (e.g., angled surface 626 of FIG. 6) of the rotational clip slides against an angled surface (e.g., angled surface 624 of FIG. 6) of the latch so as to cause compression of the cap spring and a latch spring (e.g., latch spring 612 of FIG. 6); continue to slide an angled surface of the rotational clip against the angled surface of the latch until an engagement structure (e.g., engagement structure 622 of FIG. 6) of the latch becomes aligned with an aperture (e.g., aperture 628 of FIG. 6) formed in the engagement member of the rotational clip; and applying a pushing force to the engagement structure of the latch by the latch spring so that the latch's engagement structure travels into the aperture formed in the engagement member of the rotational clip. Consequently, the security tag is securely coupled to the article.

Sufficient retention of the article is provided in 2212 such that the security tag is unable to slip off of the article and/or be forcibly pulled off of the article, while staining of the article as a result of oxidization, outgassing and/or chemical interactions is also being prevented. The sufficient retention is facilitated by the compression of the article between the two pads and/or the provision of a non-slip grip of the security tag's pads to the article. The stain prevention is facilitated via the use of pads formed of a TPV material. In outgassing scenarios, venting of released gasses may be provided by allowing the gasses to pass through one or more channels formed between the first and second pads into a surrounding environment.

At some later time, a decision is performed to determine if the security tag should be decoupled from the article. If it is determined that the security tag should not be decoupled from the article [2214:NO], then method 2200 waits for a period of time before performing a second iteration of decision.

In contrast, if it is determined that the security tag should be decoupled from the article [2214:YES], then steps 2216-2220 are performed. Step 2216 involves applying a magnetic field to the latch so as to cause the latch to disengage the rotational clip. Compressing the rotational clip by the operator to relive the force from a cap spring may be required to allow the latch to travel under the magnetic force. Step 2218 involves rotating the rotational clip in a direction away from the housing base of the security tag. Step 2220 involves removing the article from the security tag. Thereafter, step 2222 is performed where method 2200 ends or is repeated using another article.

All of the apparatus, methods, and algorithms disclosed and claimed herein can be made and executed without undue experimentation in light of the present disclosure. While the invention has been described in terms of preferred embodiments, it will be apparent to those having ordinary skill in the art that variations may be applied to the apparatus, methods and sequence of steps of the method without departing from the concept, spirit and scope of the invention. More specifically, it will be apparent that certain components may be added to, combined with, or substituted for the components described herein while the same or similar results would be achieved. All such similar substitutes and modifications apparent to those having ordinary skill in the art are deemed to be within the spirit, scope and concept of the invention as defined.

The features and functions disclosed above, as well as alternatives, may be combined into many other different systems or applications. Various presently unforeseen or unanticipated alternatives, modifications, variations or improvements may be made by those skilled in the art, each of which is also intended to be encompassed by the disclosed embodiments.

We claim:

1. A method for operating a security tag, comprising:
disposing a portion of an article between at least a first pad coupled to a housing base of the security tag and a second pad coupled to a rotational clip of the security tag, the rotational clip being coupled to the housing base;
using the rotational clip and housing base to facilitate application of a compressive force to the portion of the article disposed between the first and second pads; and
concurrently providing by the first and second pads (A) a non-slip grip on the portion of the article and (b) prevention of article staining caused by at least one of oxidization, a chemical interaction, and outgassing.

2. A method for operating a security tag, comprising:
disposing a portion of an article between at least a first pad and a second pad of the security tag;
applying a compressive force to the portion of the article disposed between the first and second pads; and
concurrently providing by the first and second pads (A) a non-slip grip on the portion of the article and (b) prevention of article staining caused by at least one of oxidization, a chemical interaction, and outgassing;
wherein the article staining is at least partially prevented by using the first and second pads which comprise a ThermoPlastic Vulcanizates ("TPV") material.

3. The method according to claim 2, wherein the TPV material comprises Santoprene™.

4. A method for operating a security tag, comprising:
disposing a portion of an article between at least a first pad and a second pad of the security tag;
applying a compressive force to the portion of the article disposed between the first and second pads; and
concurrently providing by the first and second pads (A) a non-slip grip on the portion of the article and (b) prevention of article staining caused by at least one of oxidization, a chemical interaction, and outgassing;
wherein the article staining is at least partially prevented by allowing gasses released from an outgassing material to pass through at least one channel formed between the first and second pads and flow into a surrounding environment.

5. The method according to claim 4, wherein the at least one channel is formed by a plurality of protrusions extending out and away from the first or second pad.

6. The method according to claim 5, wherein at least two of the plurality of protrusions have the same shape or different shapes.

7. The method according to claim 4, wherein the channel is formed by a first plurality of protrusions extending out and away from the first pad and a second plurality of protrusions extending out and away from the second pad.

8. The method according to claim 7, wherein the first and second plurality of protrusions comprises different numbers of protrusions.

9. The method according to claim 1, wherein the first and second pads are adhered to a housing of the security tag via a double-sided tape.

10. The method according to claim 1, wherein the article comprises optical wear.

11. A security tag, comprising:
a housing base;
a rotational clip rotatable coupled to the housing base;
a first pad coupled to the housing base; and a second pad coupled to the rotational base;

wherein the first and second pads are configured to concurrently provide (A) a non-slip grip on a portion of an article compressed therebetween and (B) prevention of article staining caused by at least one of oxidization, a chemical interaction, and outgassing.

12. The security tag according to claim 11, wherein the article staining is at least partially prevented by using the first and second pads which comprise a ThermoPlastic Vulcanizates ("TPV") material.

13. The security tag according to claim 12, wherein the TPV material comprises Santoprene™.

14. The security tag according to claim 11, wherein the article staining is at least partially prevented by allowing gasses released from an outgassing material to pass through at least one channel formed between the first and second pads and flow into a surrounding environment.

15. The security tag according to claim 14, wherein the at least one channel is formed by a plurality of protrusions extending out and away from the first or second pad.

16. The security tag according to claim 15, wherein at least two of the plurality of protrusions have the same shape or different shapes.

17. The security tag according to claim 14, wherein the channel is formed by a first plurality of protrusions extending out and away from the first pad and a second plurality of protrusions extending out and away from the second pad.

18. The security tag according to claim 17, wherein the first and second plurality of protrusions comprises different numbers of protrusions.

19. The security tag according to claim 11, wherein the first and second pads are adhered to a housing of the security tag via a double-sided tape.

20. The security tag according to claim 11, wherein the article comprises optical wear.

* * * * *